US007152371B2

(12) United States Patent
Vaccari et al.

(10) Patent No.: US 7,152,371 B2
(45) Date of Patent: Dec. 26, 2006

(54) SWING FLAP FOR THE ENTRY AND EXIT OF SMALL PETS WITH LAST TRANSIT DIRECTION INDICATOR

(75) Inventors: Carlo Vaccari, Castelgomberto (IT); Alfred Pellegrini, Montebelluna (IT)

(73) Assignee: Ferplast S.p.A., Castelgomberto (IT)

( * ) Notice: Subject to any disclaimer, the term of this patent is extended or adjusted under 35 U.S.C. 154(b) by 374 days.

(21) Appl. No.: 10/498,170

(22) PCT Filed: Dec. 12, 2002

(86) PCT No.: PCT/IT02/00786

§ 371 (c)(1),
(2), (4) Date: Jun. 8, 2004

(87) PCT Pub. No.: WO03/052230

PCT Pub. Date: Jun. 26, 2003

(65) Prior Publication Data

US 2005/0091925 A1 May 5, 2005

(30) Foreign Application Priority Data

Dec. 14, 2001 (IT) ..... VR2001A0134

(51) Int. Cl.
*E06B 7/28* (2006.01)

(52) U.S. Cl. ..... 49/169; 160/116

(58) Field of Classification Search ..... 49/169, 49/163, 168; 160/180, 2, 116, 101; 52/455, 52/458; 119/484
See application file for complete search history.

(56) References Cited

U.S. PATENT DOCUMENTS

| | | | | |
|---|---|---|---|---|
| 3,138,829 | A | 6/1964 | Grose | 20/16 |
| 5,117,890 | A | 6/1992 | Taylor et al. | 160/180 |
| 5,829,196 | A | 11/1998 | Maier | 49/181 |
| 5,992,096 | A * | 11/1999 | De La Cerda et al. | 49/169 |
| D445,915 | S * | 7/2001 | Kirk | D25/48 |
| 6,385,909 | B1 * | 5/2002 | Marsh et al. | 49/169 |
| 6,725,806 | B1 * | 4/2004 | Gribble | 119/484 |

FOREIGN PATENT DOCUMENTS

GB 2 223 049 3/1990

OTHER PUBLICATIONS

International Search Report of Mar. 25, 2003.

* cited by examiner

*Primary Examiner*—Hugh B. Thompson, II
(74) *Attorney, Agent, or Firm*—Charles Berman, Esq.; R. Joseph Foster, Esq.; Greenberg Traurig, LLP

(57) ABSTRACT

A swing flap (10) for the entry and exit of small pets, which comprises a frame (812), which can be fixed to an opening (13) made in a door or a wall, equipped at the top with hinged means of constraint for a flap (22), and having a strip (11) indicating the direction of the last transit made by the animal.

6 Claims, 3 Drawing Sheets

SWING FLAP FOR THE ENTRY AND EXIT OF SMALL PETS WITH LAST TRANSIT DIRECTION INDICATOR

This application is a 371 of PCT/IT02/00786, filed Dec. 12, 2002.

TECHNICAL FIELD

This invention concerns a swing flap for pets with a presence indicator and a last transit direction indicator.

More in particular, this invention refers to a swing flap for the differentiated entry and exit of pets.

This invention can be applied in the industry for the production of articles for pets.

BACKGROUND ART

The use of swing flaps fitted to doors to allow the independent exit and entry of pets without having to continually open and close the door, also to prevent any damage to the door as a result of scratching and knocks made by the animals, is a known fact.

An opening is generally made in the door, close to the ground, bordered by a support frame equipped at the top with pins designed to act as hinges for the flap to swing open as a result of the pressure exercised by the animal and close by means of gravity.

It is currently possible to use flaps connected to servomechanisms, for example a linear actuator, which can be controlled by special electronic units that can receive a signal from a transmitter on the collar of the animal wishing to pass through the flap, thus preventing undesired entries and exits.

Current background art also includes solutions that foresee the use of electromagnetic devices consisting of a reed switch and a diode on a circuit, which is closed by the entry or exit of the pet wearing a collar fitted with a magnet. In this case too, closure of the circuit enables the movement of a linear actuator designed to open and close the flap.

There are also electronic type solutions using a transponder which dialogues with a special electronic unit which is designed to control the opening and closing of the flap by means of actuators of various types.

One disadvantage is represented by the fact that the presence of the pet inside the house is not indicated in any way, a difficult situation especially if the pet is small and thus sometimes difficult to find.

Another disadvantage is represented by the fact that flaps controlled by electronic or electromagnetic devices are relatively expensive and are also not very reliable. These devices may in fact not be enabled as a result of abrupt movements of the animal or other accidental reasons, not least the loss of a collar fitted with a transmitter or a magnet.

DESCRIPTION OF THE INVENTION

This invention aims to provide a swing flap with a presence indicator that can eliminate or significantly reduce the drawbacks described above.

This invention also proposes to provide a swing flap which is easy to manufacture and can be produced at a low cost, thus being economically advantageous.

Another aim of this invention is to provide a swing flap, which is universally applicable to any door or wall.

This is achieved by means of a swing flap for pets with a presence indicator and having the features described in the main claim.

The dependent claims described advantageous embodiments of the invention.

The swing flap with presence indicator according to this invention comprises a frame, which can be fixed to an opening made in a door or in a wall, equipped at the top with hinged means of constraint for a flap, which presents an indicator strip, hinged to the free end of the flap, protruding when in action from the external or the internal part of the said door or wall.

According to this invention the swing flap is equipped with shock absorber means to control the angular opening during the transit of a pet.

The shock absorber means can consist of elastic loading means that can be applied to the hinges connecting the flap to the frame.

These shock absorber means can offer differentiated resistance in relation to the position of the flap in order to prevent abrupt acceleration of the flap.

The swing flap is equipped with a function selector which ensures a number of possibilities and in particular the opening of the flap can be permitted:

for entry into the house only, for exit from the house only, for both entry and exit, for neither entry nor exit.

The edges of the flap and the corresponding inner edges of the frame are fitted with elastic seals. According to the background art, these seals can be magnetic to ensure an airtight closure.

DESCRIPTION OF THE DRAWINGS

Other features and advantages of the invention will become apparent from the following description of an embodiment of the invention, provided purely as a non-restricting example, with reference to the accompanying drawings, in which.

DESCRIPTION OF A FORM OF EMBODIMENT

In the figures, the reference number 10 indicates in general a swing flap, in the case in question a swing flap 10 with a presence indicator and an indicator 11 of the last transit direction of a pet.

Figure 1:
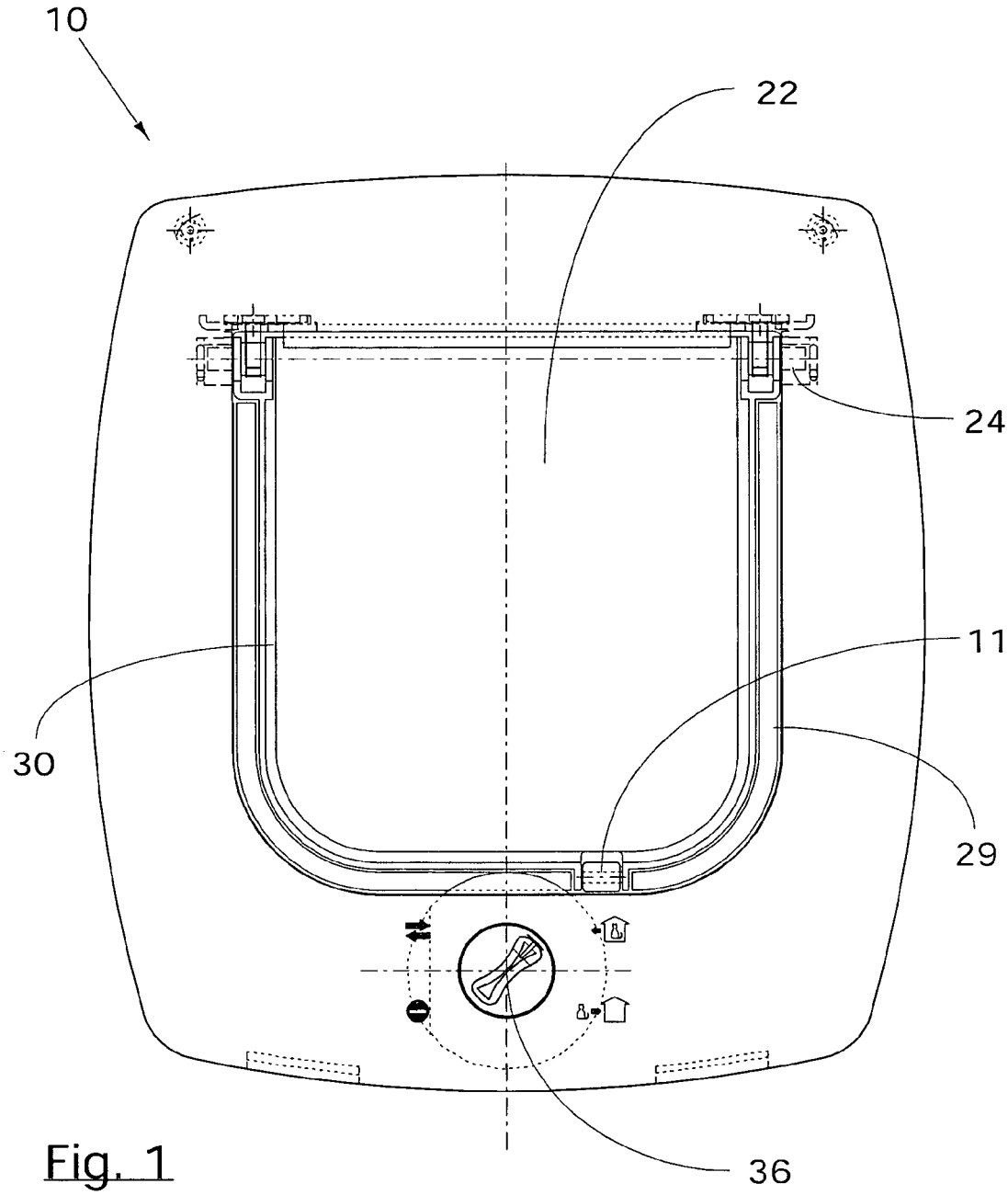
FIG. 1 represents a front view of a swing flap according to the invention.
Figure 2:
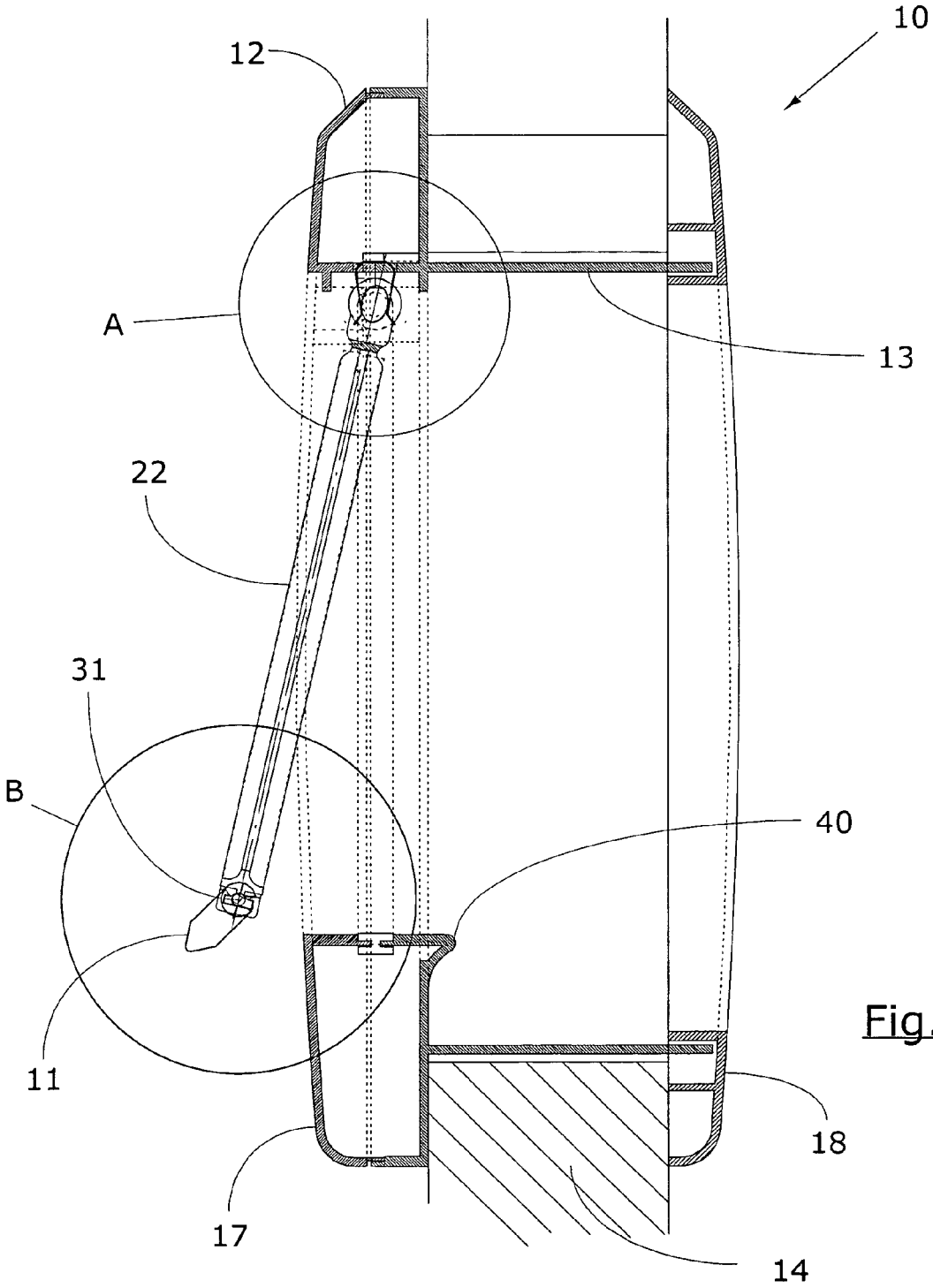
FIG. 2 is a cross-section of the flap shown in FIG. 1.

With reference first of all to FIGS. 1 and 2, the swing flap 10 comprises a frame 12 positioned and fixed inside a respective opening 13 made in a door or wall 14 of a house, which separates an internal space from an external space.

The frame 12 can consist of an internal half shell 17 and an external half shell 18, cooperating reciprocally and with at least one of these fixed to the door or wall, presenting the respective passageways.

The passageway of the internal half shell 17 is smaller than the passageway of the external half shell, being equipped with a base plinth, which partially obstructs the opening 13.

The upper portion of the passageway 19 of the internal half shell 17 presents hinged means of constraint for a flap 22 designed to close the passageway 19.

As can be seen in FIG. 1, the hinged means of constraint can consist of housings designed, in action, to accommodate respective pins 24 integral with the upper part of the flap 22.

In this way, the flap 22 is free to swing from a closed position of the passageway to an open position to allow pets to pass through.

The swing flap 10 is equipped with shock absorber means to control the swing of the flap 22; these means can consist of elastic loading means positioned in correspondence with the housings of the pins 24.

Figure 3:
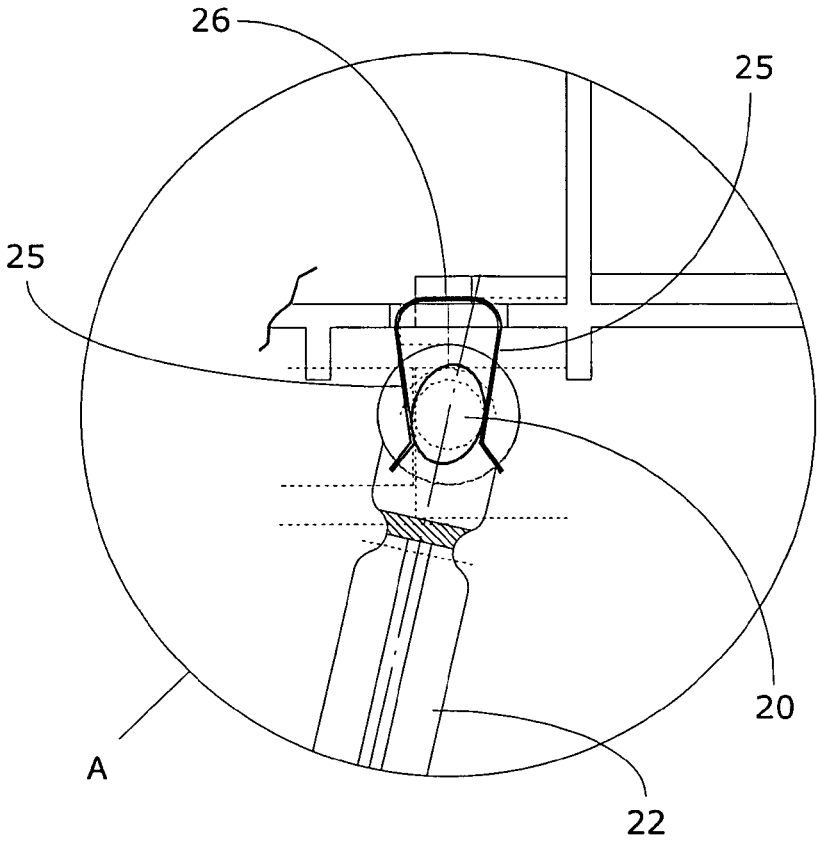
FIG. 3 shows an enlarged prospective view of a shock absorber means.

With reference to FIG. 3, the elastic loading means can consist of metal foils 25 integral with a further blade 26 fixed, for example restrained, to the frame 12 just above each respective housing.

As can be seen in FIG. 3, each pin 24 presents a portion 20 with an elliptical cross-section and its longer axis aligned with the extension of the flap 22.

In this way, the angular excursion of the flap 22, with respect to the vertical closed position of the passageway 19, is proportionally contrasted by the elastic return action of the foils 25 acting as shock absorbers.

The outer edges of the flap 22 and the edges of the passageway are equipped with grooves designed to house seals 29, 30.

These seals 29, 30 ensure airtight closing of the swing flap 10 when the flap 22 is in the vertical position.

Additionally, according to the background art, the seals 29, 30 can be made from a mixture containing magnetic powder in order to make them cooperate during the closing phase of the swing flap 10.

The free end of the flap 22, in action proximal to the base plinth, presents a pin 31 designed to support an indicator strip 11.

Figure 4:
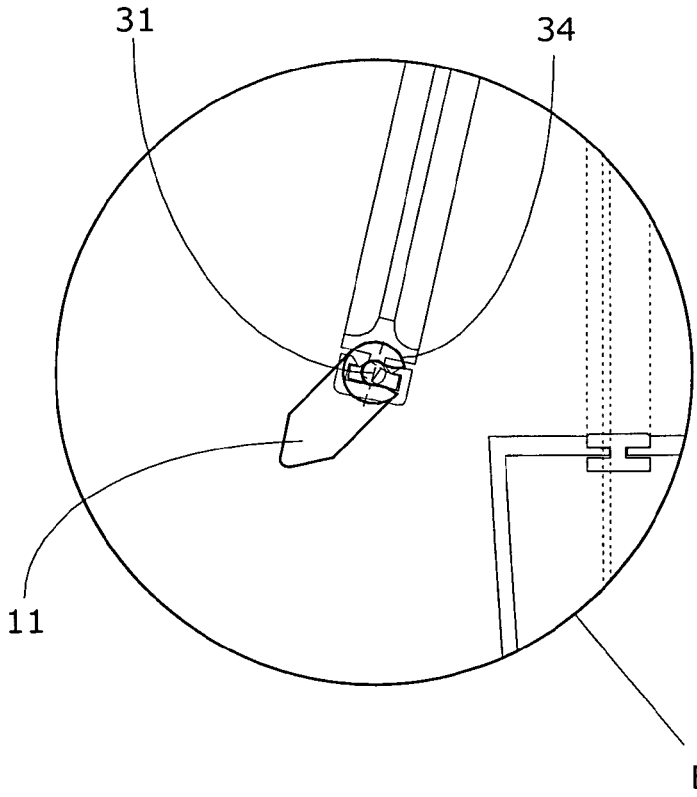
FIG. 4 shows an enlarged partial side view of an indicator strip.

With reference to FIG. 4, it can be seen that the indicator strip 11 comprises a tab whose sides present alphanumeric indications, in particular one side can show the word "IN" and the other side the word "OUT" to indicate whether the pet is present in the house or not.

The tab can have a bevelled free end and is integral with a collar 34 which has a longitudinal slot. The collar 34 is designed to accommodate the pin 31 to allow the indicator strip 11 to swing freely with respect to the flap 22.

The internal half shell 17 is equipped with a knob 36 which is hinged to it and is easily accessible to a user from inside the house. The knob 36, which can be housed inside a respective cavity in the base plinth 21, is fitted, according to the background art, with a pair of elements that control the closing and opening of the flap 22.

By turning the knob 36 it is possible to obtain positions of the control elements that allow the swinging of the flap 22 to be controlled selectively.

The knob 36 is therefore designed to act as a selector which ensures a number of possibilities of use of the swing flap 10 and in particular the opening of the flap 22 can be permitted:

for entry into the house only,
for exit from the house only,
for both entry and exit,
for neither entry nor exit.

The base plinth can present a projection 40, facing the passageway of the external half shell 18, designed to block the indicator strip 11 in a position which is visible from the outer space after the outward transit of the pet.

This indicator strip 11 is on the other hand clearly visible from the inner space 15 once the pet has returned inside the house.

Any abrupt swinging of the flap 22, with consequent uncontrolled excursions of the indicator strip 11, are prevented by the shock absorber action of the foils 25 with respect to the elliptical pins 20. In this way, the indicator strip 11, showing alphanumerical indications on its sides also in different colours, is always projecting in the same direction as the transit of the pet through the swing flap 10, giving a precise indication as to the presence of the pet inside or outside the house, according to the last transit through the flap.

The invention is described above with reference to a preferred form of embodiment. It is nevertheless clear that the invention is susceptible to numerous variations within the framework of technical equivalents.

By way of example, forms of embodiment (not shown in the figures) are possible in which the shock absorber means are the viscose type or in case with a friction action.

The invention claimed is:

1. A pet door for the entry and exit of small pets, which comprises a frame, which can be fixed to an opening made in a door or a wall, and frame being equipped at a top of the frame with a swing flap connected through hinges to said frame, said flap further comprising an indicator strip having a tab indicating the direction of a last transit made by an animal by being projected towards said direction, wherein said indicator strip is pivotally hinged to the bottom edge of the flap.

2. The pet door of claim 1, wherein the flap is equipped with shock absorber means applied to the hinges connecting the swing flap to the frame for controlling its angular opening during transit of the pet.

3. The pet door of claim 2, wherein the shock absorber means consist of elastic loading means that can be applied to the hinges that connect the flap to the frame.

4. The pet door of claim 3, in which the elastic loading means consists of metal foils integral with a further blade fixed to the frame.

5. The pet door of claim 1, in which the flap is equipped with pins designed to act with the hinges of the frame, at least one portion of these pins having an elliptical cross-section.

6. The pet door of claim 1, wherein each opposite side of the indicator strip presents alphanumeric indications and/or different colours.

* * * * *